US006592459B2

(12) United States Patent
Parra et al.

(10) Patent No.: US 6,592,459 B2
(45) **Date of Patent: *Jul. 15, 2003**

(54) UNIVERSAL NON-PROGRESSIVE REWARD FOR LIVE CASINO GAMES

(76) Inventors: Anthony C. Parra, 516 Harlowe La., Naperville, IL (US) 60565; Debra L. Parra, 516 Harlowe La., Naperville, IL (US) 60565

( * ) Notice: Subject to any disclaimer, the term of this patent is extended or adjusted under 35 U.S.C. 154(b) by 0 days.

This patent is subject to a terminal disclaimer.

(21) Appl. No.: 09/947,232

(22) Filed: Sep. 7, 2001

(65) Prior Publication Data

US 2002/0010014 A1 Jan. 24, 2002

Related U.S. Application Data

(63) Continuation-in-part of application No. 09/243,353, filed on Feb. 1, 1999, now Pat. No. 6,299,533, which is a continuation of application No. 08/961,357, filed on Oct. 30, 1997, now Pat. No. 5,876,283.

(51) Int. Cl.[7] ..... A63F 1/00; G07F 17/34

(52) U.S. Cl. ..... 463/17; 463/20; 463/42; 273/292; 273/143 R; 273/138.1; 273/138.2

(58) Field of Search ..... 273/143 R, 138.2, 273/138.1, 292; 463/20, 6, 18, 17, 42

(56) References Cited

U.S. PATENT DOCUMENTS

| | | | | | |
|---|---|---|---|---|---|
| 4,861,041 | A | * | 8/1989 | Jones et al. | 273/292 |
| 5,560,603 | A | * | 10/1996 | Seelig et al. | 463/6 |
| 5,797,794 | A | * | 8/1998 | Angell | 463/18 |
| 5,941,772 | A | * | 8/1999 | Paige | 463/20 |
| 6,299,533 | B1 | * | 10/2001 | Parra et al. | 463/17 |

* cited by examiner

*Primary Examiner*—Benjamin H. Layno
(74) *Attorney, Agent, or Firm*—Robert L. Marsh

(57) ABSTRACT

A player at a casino is provided the opportunity to wager an additional bet to win an additional reward in which several types of games and a plurality of tables of each set vie for the same reward. Each gaming table has a playing surface suitable for use by a game, and all the game tables participating in the universal non-progressive reward have the same predetermined number of play stations, or a multiple of that number. Each play station also has an identification number or symbol which is one of a set of identification numbers, with each number in the set occurring the same number of times at each table. The game includes an additional reward token purchasable by a player which is displayed on the play surface to designate that the player is wagering in the game. Each type of casino game has a set of winning conditions under which a player positioned at a given play station is entitled to win a portion of the additional reward.

27 Claims, 5 Drawing Sheets

UNIVERSAL NON-PROGRESSIVE REWARD FOR LIVE CASINO GAMES

The present application is a continuation in part of the applicant's prior co-pending application filed Feb. 1, 1999 as Ser. No. 09/243,353 now U.S. Pat. No. 6,299,533 which in turn was a continuation in part of an application filed Oct. 30, 1997 as Ser. No. 08/961,357 now U.S. Pat. No. 5,876,283. The present invention relates to supplemental casino games, and in particular to an additional non-progressive reward which can be employed with any of a number of games played in a casino.

BACKGROUND OF THE INVENTION

Casinos have a number of games which appeal to a person's temptation to take a risk, with the hope and expectation that the risk taken at the right time and under the right circumstances will result in a return which far exceeds the investment. A typical casino provides many games to a prospective customer including blackjack, poker, baccarat, roulette, craps and slots.

Recently, progressive games have been introduced into casino play. The progressive game includes a jackpot and participants who wish to wager on the progressive game contributing a fixed wagering amount by token or cash into a jackpot, and if the participant does not win, a portion of his contribution is added to the jackpot. Accordingly the jackpot becomes progressively larger with each unsuccessful bet until a winner is determined.

Jones, U.S. Pat. No. 4,861,041 taught a method whereby a progressive game could be offered as a side bet to a game of poker. In our prior U.S. Pat. No. 5,573,248 we taught a method whereby a progressive game could be offered as a side bet to a game of craps. In our prior U.S. Pat. No. 5,876,285 we also taught a method whereby a progressive game could be offered as a side bet to a game of baccarat.

Casinos have found that progressive games facilitate in the attraction of players into games, the retention of players who have already engaged in a game, and on the whole, increase table or slot profitability. Casinos are, therefore, seeking to incorporate a supplemental game with each type of game played within the casino.

There are however certain draw backs to incorporating a progressive game into the play at the tables of a casino. First, such games require the programming of a computer to receive impute from all the participating tables and the modification of the gaming tables to receive the associated hardware. Once installed a progressive game will attract participation from players after a sizeable jackpot has been built up, but it will draw little interest for a lengthy period of time during which the jackpot is small following a "win." Also, the mechanical equipment needed to operate existing progressive games are subject to declaring a false winner or may overlook a legitimate winner. It would be desirable therefore to provide a supplemental reward to the players of a gaming table which would attract participation by players immediately after a "win," which would not be subject to declaring a false winner or overlooking a true winner, and would not require the modification of gaming tables to receive necessary hardware.

It would also be desirable to provide a non-progressive reward which would interact with a number of different games in the casino. It would also be desirable to have a reward whereby a player at a black jack table could participate and win a portion of a reward jackpot in the event of the occurrence of a given winning combination in a poker hand at a distant table in the casino.

SUMMARY OF THE INVENTION

Briefly, the present invention is embodied in a universal non-progressive additional reward wherein a player at a casino is provided the opportunity to wager an additional bet to win the additional reward where there are several types of games with each type game played on a plurality of tables. In accordance with the invention, each gaming table has a playing surface suitable for use by the game for which the playing surface is intended, and all the game tables participating in the universal non-progressive reward have the same predetermined number of play stations, or a multiple of the predetermined number with each play station suitable for use by one player. Each play station also has an identification number or symbol which is one of a set of identification numbers equal in number to the predetermined number, with each number in the set occurring the same number of times at each table.

The game includes an additional reward token or other negotiable item purchasable by a player in advance of play at one of the play tables, the token to be displayed on the play surface at the commencement of the play of a game at a table to designate that the player is wagering in the game for the additional reward.

Each type of casino game has a set of winning conditions under which a player positioned at a given play station is entitled to win a portion of the additional reward. A player at play station number 4 of a blackjack table, for example, would win a portion of the additional reward if he deposits an additional reward token on the table before the commencement of a hand and he was dealt a pair of fours, and the dealer was likewise dealt a pair of fours on both of their first two cards. The set of conditions under which a player at a numbered play station of a blackjack table, therefore, has a winning combination if the cards dealt to both the dealer and the player are identical to the number of his play station.

For roulette, a player at a play station bearing a given number who deposits an additional reward token on the table to participate in the game would win if the player bets on a number associated with his play station, the ball comes to rest in the hole for that number, and the rotating portion of the wheel stops with the ball against a section of the surrounding race which bears the same number as the player's play position.

A player at a play station of a poker table who has deposited an additional reward token on the table has a winning combination when the dealer has a completed hand of four of a kind and the four cards correspond to the number of his play position.

A player at a slot machine would win if he deposits the maximum number of coins in the machine, including one for the additional reward, and the top award combination occurs on the reels after the handle has been pulled, and the top award includes a number corresponding to the number of the player's play station.

In accordance with one embodiment of the invention there is but one winner of an additional reward for each play. In accordance with an alternate embodiment of the invention, when the selected set of conditions for winning a reward occurs for a first player at a first play station having a given first number, a portion of the jackpot is paid to a second player positioned at a second play station for which an additional reward token has been deposited on the table and the number for the play station of the second player is identical to that of the first play station. In this embodiment the first player becomes a primary winner and the second player is a secondary winner, both of whom share in the reward. Any of a number of formulas may be used for apportioning the reward between the first and second players.

The invention further envisions a proxy additional reward wherein a player may wager on the possibility that the additional reward will be won at a play station identified by a number different from the player's own play station number. The proxy additional reward game may be played by requiring the player to deposit an additional reward token on one or more of the six numbered locations on a betting zone having locations marked for receiving tokes, one location for each of the six play stations.

In our U.S. Pat. No. 5,573,248 we disclosed a craps game and table having six play stations for receiving six players at the game and a progressive game employing a first pair of dice for playing a conventional craps game and a third die for playing the progressive part of the game. Substantially the same rules apply to the game for the non-progressive reward. In the parent to the present application we also disclosed a baccarat game in which a player at a play station with a given number will win a progressive game if the first two cards in the player's hand and the first two cards in the banker's hand all bear numbers identical to the number of the play station. Those rules are also useable in playing for a non-progressive reward.

In accordance with the present invention, the players at any combination of a number of types of casino games can vie for the same additional reward. To integrate a number of types of games to compete for a single additional reward, the number of play stations on each game table suitable for vying for the additional reward must be the same for all tables, or a multiple of that number. In the preferred embodiment the play tables of all games will have six play stations to accommodate six players or twelve stations to accommodate twelve players. A gaming table for craps was disclosed in our prior U.S. Pat. No. 5,573,248 would accommodate six players. The table disclosed by Jones U.S. Pat. No. 4,861,041 can be adapted to accept six players and in like manner all of the game tables of each type of game in the casino vying for the additional reward would have six play stations, each of which is numbered one through six, or twelve play stations in two sets of six numbered locations.

The game can be configured such that there is only one winner when a winning combination arises. Alternately, when a first player at a first play station receives a winning combination, the rules can provide that a second player at a second table at a play station having a number identical to that of the first play station will share in the universal additional reward if he has deposited an additional reward token on the table.

BRIEF DESCRIPTION OF THE DRAWINGS

A better understanding of the present invention will be obtained after a reading of the following detailed description taken in conjunction with the drawings wherein.

DETAILED DESCRIPTION OF THE PREFERRED EMBODIMENT

Figure 1:
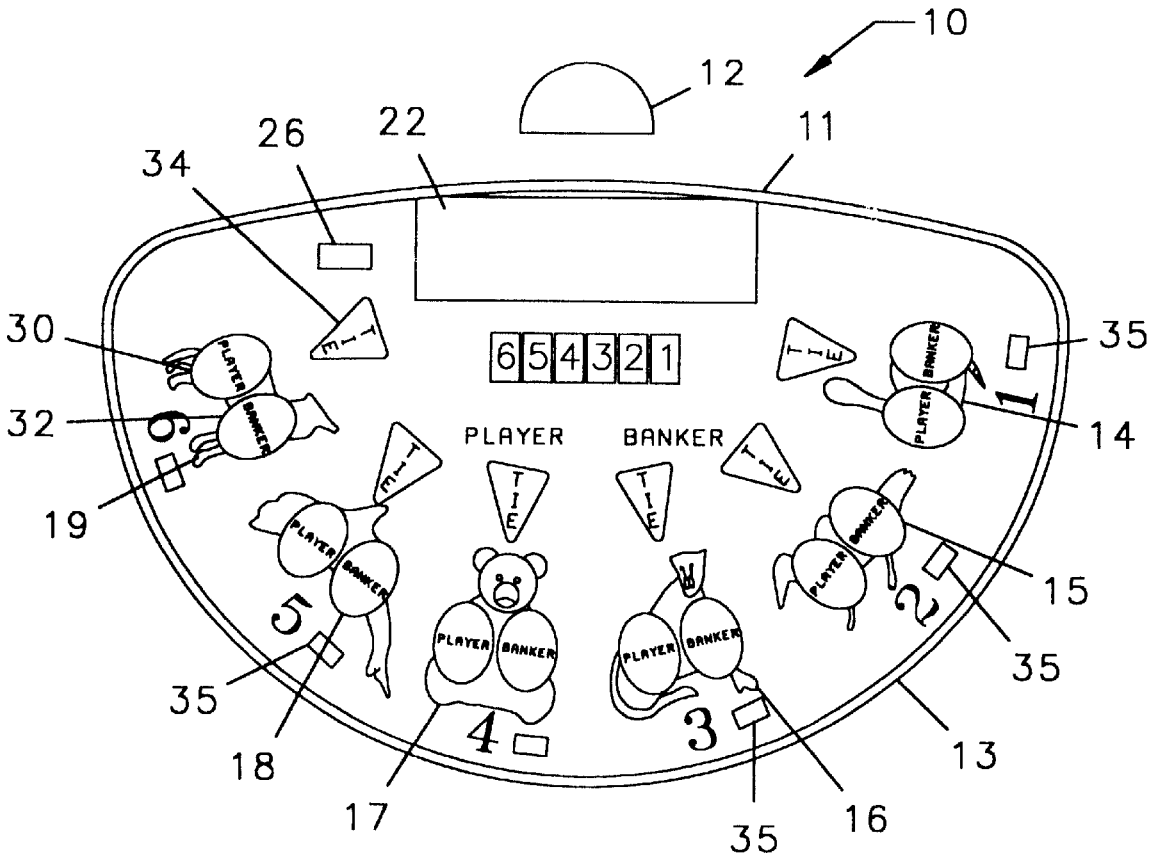
FIG. 1 is a top elevational view of a play surface for use with a game of baccarat.

Referring to FIG. 1, a baccarat table 10 has a banker's edge 11 allowing a dealer seated in a chair 12 to face a plurality of players positioned at play stations along the arcuate outer edge 13. Six play stations 14, 15, 16, 17, 18, 19 are depicted and each of the play stations bears an identification number such that the play stations 14, 15, 16, 17, 18, 19 are numbered one through six respectively. The table includes an area 22 where the dealer can retain chips and a drop slot 26 into which cash exchanged by the gambling establishment for chips may be placed.

An important element of the universal reward is that the same set of numbers (preferable 1 through 6) are assigned to the play stations of every table vying for the additional reward, and every table has the same given numbers (preferably 6) of separately numbered play stations or a multiple of that given number (preferably 12).

Although the play stations 14–19 are described as being "numbered" and are depicted as bearing numerals 1 through 6, it should be appreciated that the play stations could be identified by lettering them A, B, C, D, E and F. Other symbols may also be used to identify the various play station positions, and for the purposes of this discussion the terms "numbered," "identification numbers" or "numbering" shall refer to all such methods of identification.

Figure 9:
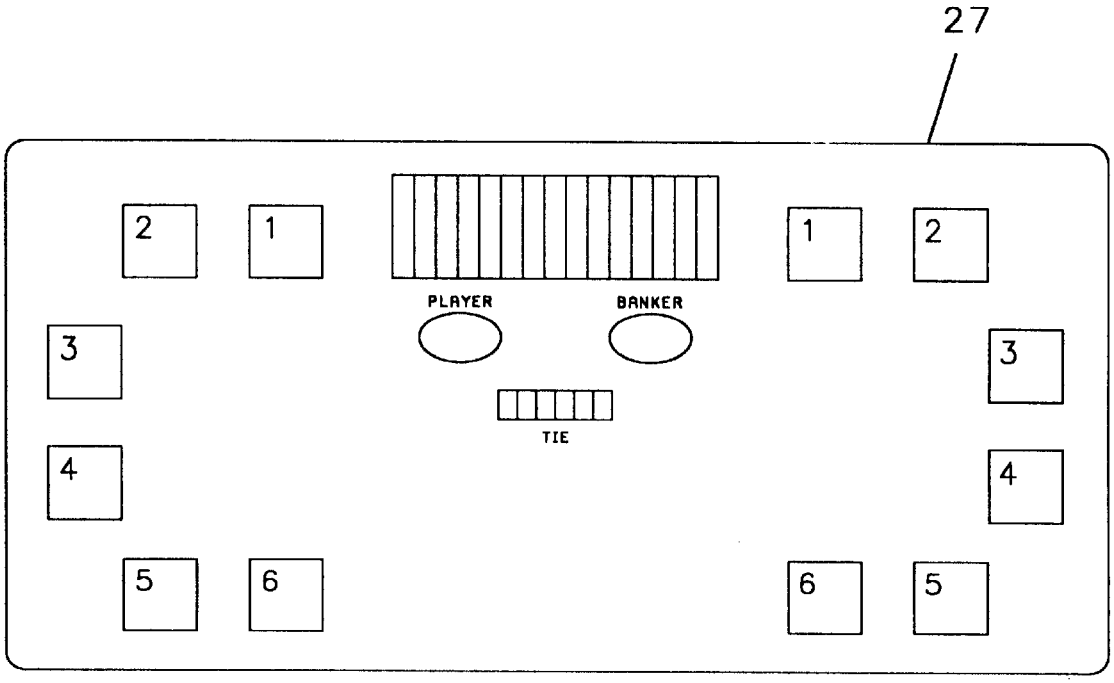
FIG. 9 is a schematic top view of an alternate embodiment of a baccarat table.

Baccarat is generally played at a table which can accommodate more than six players, and a larger baccarat table such as shown in FIG. 9 can be employed with the present invention where numbers of play stations at a larger table are a multiple of the number of play stations at a smaller table. The table 27 is depicted as having twelve play stations divided into two groups of six with each group being numbered one though six.

The rules of the game of baccarat are well known and are not set forth herein, however, each of the six play stations 14–19 has markings suitable for use in the game of baccarat including a player bet area 30, a bank bet area 32, and tie bet area 34. The bet areas 30, 32, 34 are intended to receive chips from a player at the play station who desires to place a bet on the success of the player or the banker, or for a tie, on each hand of baccarat.

Figure 2:
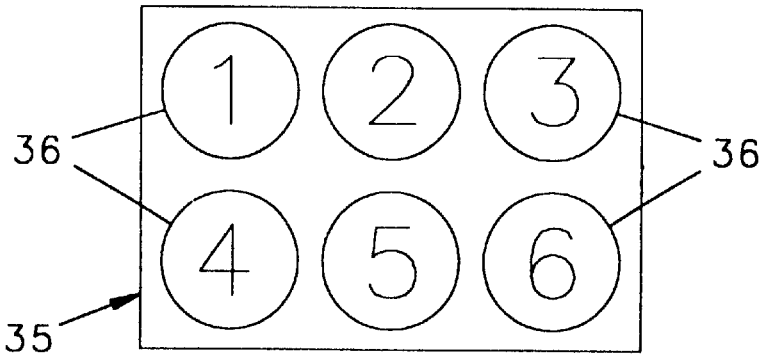
FIG. 2 is a top elevational view of a betting zone for a proxy additional reward.

Referring to FIGS. 1 and 2, each play station 14–19 also has a proxy additional reward betting zone 35 for receiving additional reward tokens for wagering on the proxy additional reward. The proxy additional reward betting zone 35 has six betting locations 36 in an array, the six locations numbered 1 through 6 as shown in FIG. 2. To place a proxy additional reward bet on a play station number (including the number of the player's own play station) the player will deposit an additional reward token on the numbered location 36 for the play station number of his choice.

Figure 3:
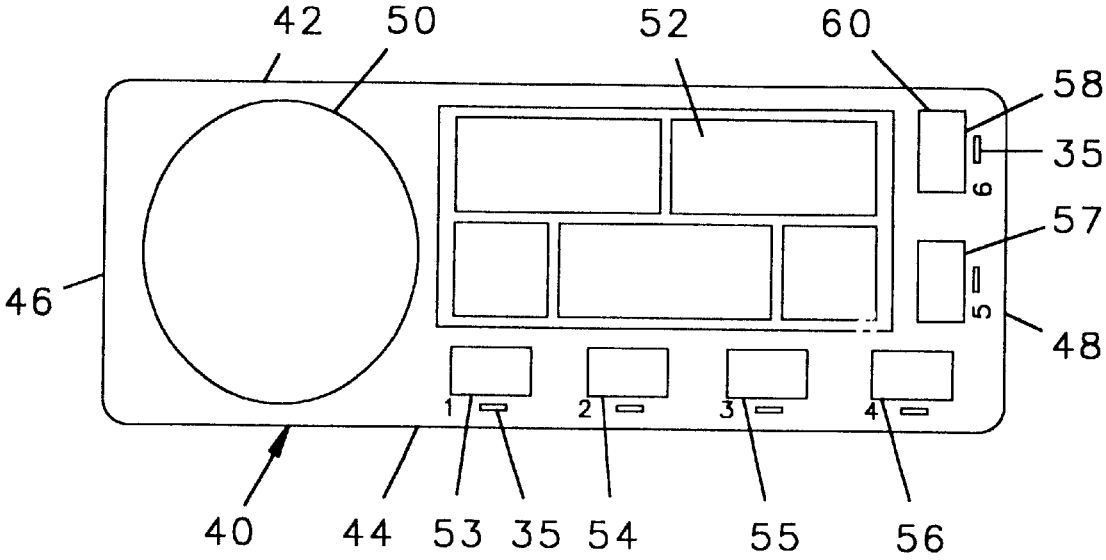
FIG. 3 is a top elevational view of play surface for use with a game of roulette.

Referring to FIG. 3, a roulette table 40 is generally rectangular in shape with a first long side 42 for use by a dealer, an opposing second long side 44 and first and second short sides 46, 48 respectively. A roulette wheel 50 is positioned near the first short side 46 and a betting pattern 52 is positioned adjacent to the roulette wheel 50 and adjacent the first long side 40 such that a dealer can operate the wheel 50 and supervise bets. Four play stations numbered 53, 54, 55, 56, extend along the second long side 44 and two play stations numbered 57, 58 extend along the second short side 48 as shown. The play stations 53–58 are numbered 1 through 6 respectively and each play station has a betting area 60 with markings thereon suitable for placing bets for the game of roulette. Each play station 53–58 further has a proxy additional reward betting zone 35 as described above and shown in FIG. 2 for use to bet on the proxy additional reward.

Figure 4:
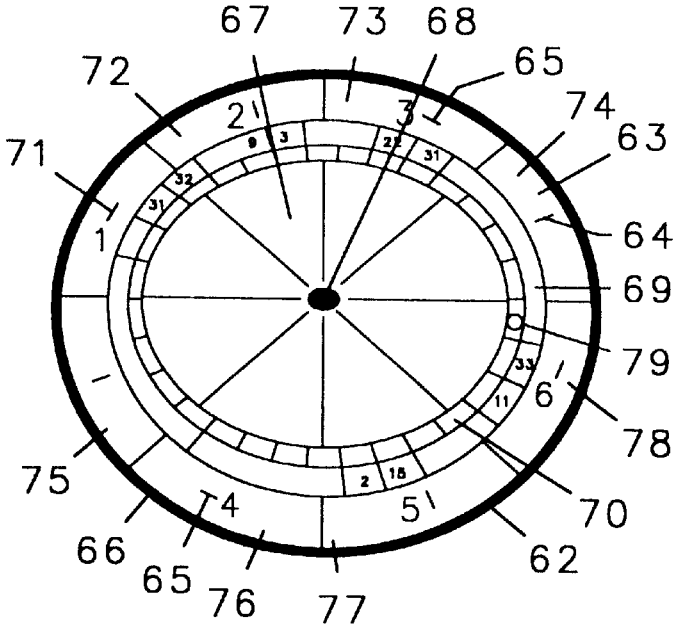
FIG. 4 is a roulette wheel for use in the table shown in FIG. 3.

Referring to FIG. 4, the wheel 62 used in conjunction with a progressive game has a stationary annular outer race 63 with ridges 64 and canoes 65 thereon, and an annular lip 66 surrounding the race 63. The rotating central portion 67 of the wheel 62 includes a capstan 68, and near the peripheral edge are the numbers 69 on the wheel. Inward of the numbers 69 is a separation ring 70 with a plurality of separator holes, one of each of the numbers 69. In accordance with the present invention, the annular outer race 63 is divided into eight sections, 71, 72, 73, 74, 75, 76, 77, 78 of which sections 71, 72, 73 are identified with indicia numbers 1, 2, and 3 respective and sections 75, 76, 77 are identified with indicia numbers 4, 5 and 6 respectively as shown. Sections 74 and 75 are left unnumbered.

The rules for playing roulette, like the rules of all casino games, are well known and are not set forth at length herein except for the portions thereof which relate to the progressive game. In the course of the game, players bet on one or more of the numbers 69 after which the central portion 67 is spun and the ball 79 is rolled around the race 63 and against the annular lip 66. Eventually the ball 79 will come to stop in a hole identified by one of the numbers 69. When the central portion 67 stops rotating, the numbered hole in which the ball has landed will be against one of the eight sections 71–78.

Figure 5:
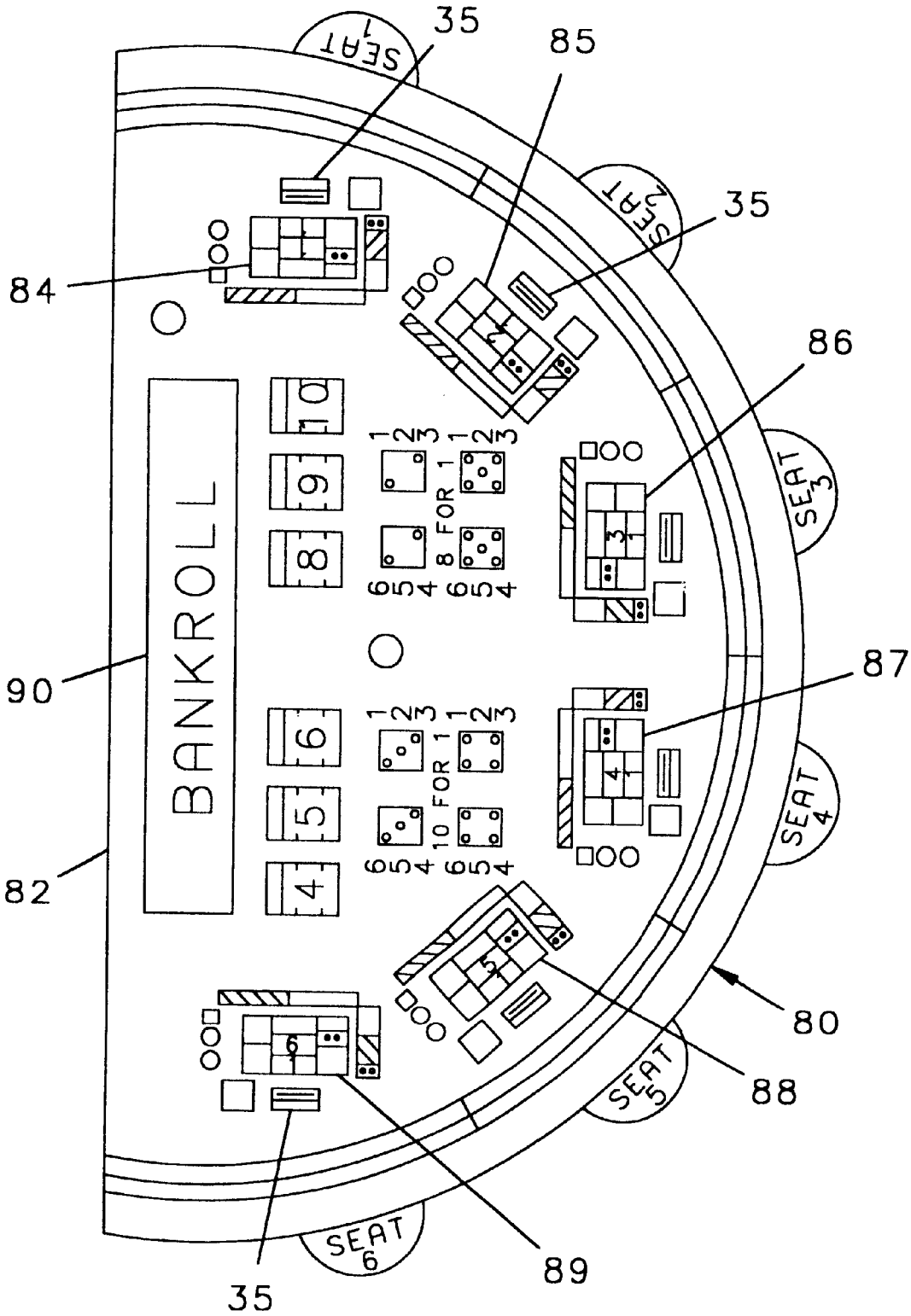
FIG. 5 is a top elevational view of play surface for use with a game of craps.

Referring to FIG. 5, crap table 80 has a substantially linear dealer's side 82 and an arcuate outer edge 83 with six play stations 84, 85, 86, 87, 88, 89, each of which is numbered 1 through 6 respectively as shown. The use of the table 80 and the rules of the game of craps are set forth in detail in our above mentioned prior U.S. Pat. No. 5,573,248 and are incorporated herein by reference. For the purposes of the present invention, however, the table 80 includes a bank roll 90 for use by a dealer positioned along the linear side 82 and each of the play stations 84–89 includes a proxy additional reward betting zone 35 allowing the players to wager for a proxy additional reward.

Figure 6:
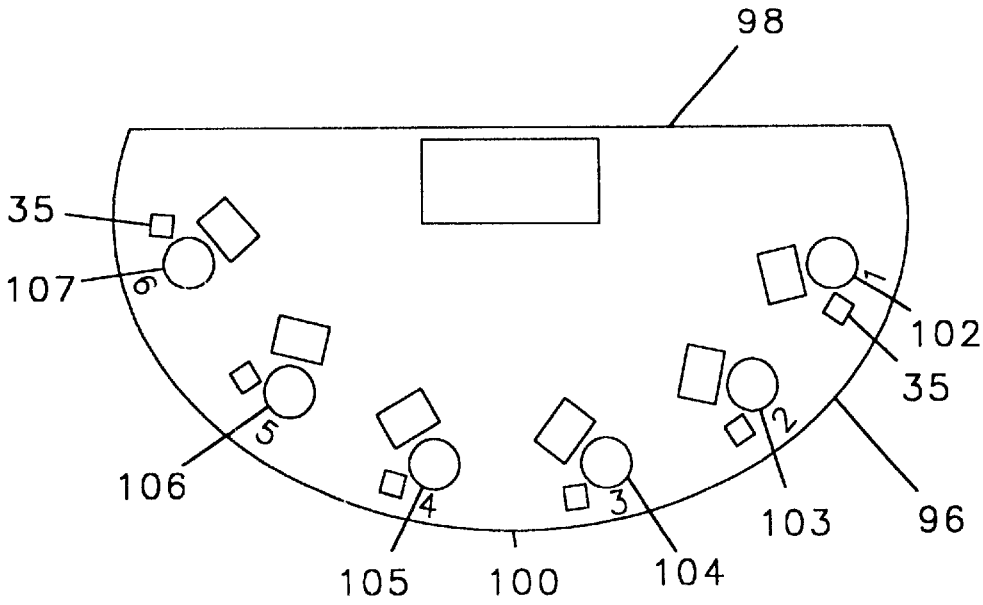
FIG. 6 is a top elevational view of a play surface for use with a game of poker or blackjack.

Referring to FIG. 6, a table 96 suitable for use for a game of poker or a game of blackjack in a casino is depicted. The table 96 has a generally linear banker's side 98, and an arcuate outer edge 100 along which are six play stations 102, 103, 104, 105, 106, 107 numbered 1 through 6 respectively. Like the play stations of the preceding tables, the play stations of the poker and black jack tables has markings suitable for use by a player of the game. Each play station 102–107 also has a proxy additional reward betting zone 35.

In accordance with the present invention, each casino game has a preselected set of winning conditions for participating in the jackpot of a progressive game. In the preferred embodiment, the winning combination for baccarat would occur when the first two cards dealt to a player's hand and the first two cards dealt to a dealer's hand are all identical and are equal to the numerical identification of the play station at which the player is seated. For example, a player at station four has a winning combination when the player's hand and the banker's hand both have a pair of fours. Similarly, a player at play station six has a winning combination when the player's hand and the banker's hand both have a pair of sixes.

For roulette, the preferred embodiment of the winning combination requires that a player first bet on a number associated with his play station. For example, the numbers 4, 14, 24, and 34 are the numbers associated with play station four and the numbers 15, 25, and 35 are the numbers associated with play station five. The winning combination occurs when the ball lands in a number associated with the player's play station and the rotating portion of the wheel 69 comes to rest with the ball against the section 71–78 bearing the same number as that of the player's play position.

Figure 7:
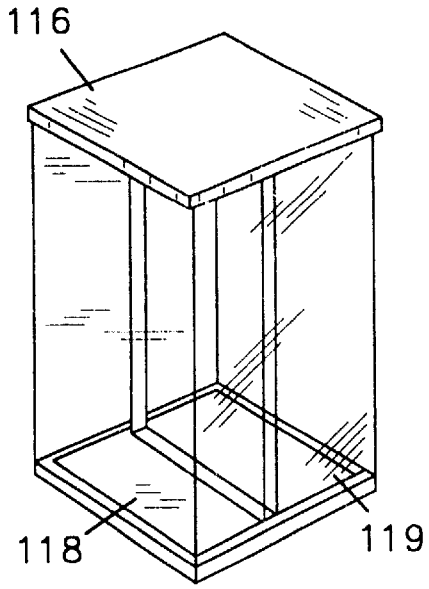
FIG. 7 is a shake container to be used with the crap table shown in FIG. 5.

In our prior U.S. Pat. No. 5,573,248 we disclosed how a progressive game can be linked to a crap table as shown in FIG. 5 where the dice are enclosed in a shake container 116 as shown in FIG. 7. The container 116 is made of a transparent material such as acrylic and has a first chamber 118 for retaining a first pair of dice for use in the game of craps, and a second chamber 119 which retains a third die employed in the progressive game. A player at a play station bearing one of the numbers one through six has a winning combination when the shake container 116 is turned and causes the dice to tumble and come to rest with the numbers showing "up" on all three of the dice being identical and equal to the number assigned to his play station.

Figure 8:
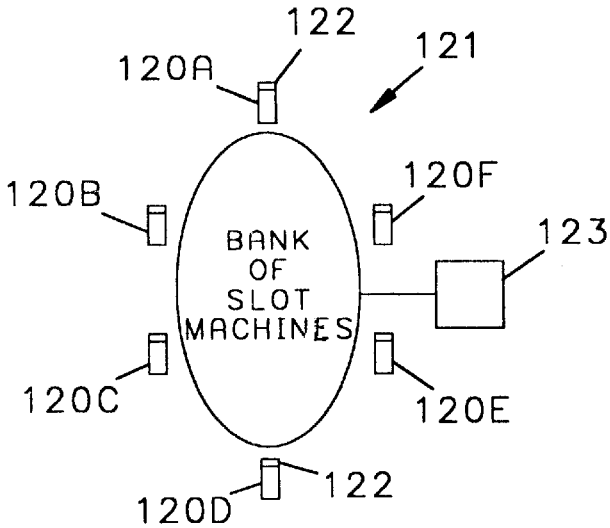
FIG. 8 is a schematic view of a bank of slot machines configured to participate in a game for an additional reward.

Referring to FIG. 8, the winning combination for a player before a numbered slot machine 120A to 120F in a bank 121 occurs when the player has deposited the maximum number of coins into the machine 120, including a coin into an additional reward game receptor 122 and, after pulling the handle, the reels display a combination for the top award available on the machine. When the winning combination occurs at a slot machine 120 and an additional reward token has been deposited in a receptor 122, the machine 120 will send a signal to a central recording center 123 to acknowledge that the player has won both the jackpot for the machine and the additional reward.

The slot machines 120A to 120F are preferably arranged in banks with the number of machines in each bank equal to the given number (preferable 6) and each machine in the bank bearing one of the set of numbers (1 to 6). Although the seat number of a slot machine is not a factor in determining whether the player is a winner when he pulls the handle, the seat number is important for determining whether the player is entitled to a portion of the additional reward.

For poker, the winning combination occurs when a dealer's completed hand has four of a kind and the numbers on the four cards are equal to the identification number for the play station at which a player is positioned.

For the game of blackjack, the winning combination occurs when the player's first two "up" cards are a pair and the dealer's first two cards (including the dealer's "up" cards and the dealer's "down" cards) are a pair and both are showing the same number as the player's play station.

Experienced poker and blackjack players who are capable of remembering the cards that have previously been played can count the high cards and determine changes in the odds. Players who count cards find it desirable to be in the last play position, that is the sixth person to be dealt cards, which is the player to the dealer's right. It is desirable therefore for the dealer at the table to deal each hand starting with a different player by utilizing a marker as shown in our first U.S. Pat. No. 5,573,248, however, the rotation of the dealer position will not change the play station number for a player.

To participate in the game for an additional reward a player will purchase additional reward tokens from the cashier at the same time that he is purchasing chips for use at the gaming tables. He will then sit at a play station bearing a number from the given set (1 through 6). While at the table the player will play the game of the table, and if he desires to participate in the play for the additional reward, he will deposit an additional reward token on the table. This can be done by placing the token in an area of the table marked for receiving additional reward tokens, or by placing the token in a place which according to prearranged terms, signals the dealer that the token is in play. The prearranged terms may require the player to place the token on top of a stack of tokens being wagered, or along sides of a stack of tokens being wagered.

The player can also participate in a game for a proxy additional reward by depositing an additional reward token on the numbered location in the proxy additional reward betting array 35.

When a player who has deposited a token for an additional reward on the table obtains a winning combination, the dealer will acknowledge the winning combination thereby allowing the player to participate in the award. In one embodiment of the game, only the player who has the winning combination and has deposited a token to participate in the additional reward is a winner. In another embodiment all other players vying for the additional reward who have deposited tokens to participate in the additional reward and are sitting at a station bearing a number (1 through 6) identical to the number of the winning play station are secondary winners who participate in a percentage of the additional reward along with the primary winner having the winning combination. In a third embodiment, proxy additional reward players who have deposited tokens on the numbered betting zones 36 in their proxy additional reward betting array 35 which correspond to the number of the winning play station number would also participate in the reward.

After each winner of the additional reward the casino will reinstate the additional reward jackpot and the play for the additional reward will be renewed.

A unique quality of the universal additional reward game is that players at many types of games may all play to win a portion of the same additional reward. A single reward will therefore attract players into a wide number of table games. Another quality of the game is that in the conditions for winning the card games, namely blackjack and poker, the dealer's hand determines the winning combination. A player cannot, therefore, determine whether he is a winner until the hand is completed, thereby extending interest in the game until the end of the hand.

While several embodiments of the present invention have been disclosed, it will be appreciated that many variations and modifications can be made without departing from the true spirit and scope of the present invention. Therefore, it is intended by the following claims to cover all such modifications and variations which come within the true spirit and scope of the invention.

What is claimed:

1. The method of providing a wagering for an additional reward to players of the games of a casino comprising the steps of providing means purchasable by a player in advance of play of one of said games, said means exercisable by said player for designating participation by said player in the play for said additional award, providing a plurality of gaming tables where each of said gaming tables has a play surface for use in one of said games played at said casino, each said play surface having a plurality of play stations thereon for use by one of said players, wherein all of said tables have the same given number of play stations or a multiple of said given number of play stations, providing a set of identification numbers where the total number of distinct identification numbers in said set is equal to said given number, assigning one of said set of identification numbers to each play station of a table with all of said set of numbers employed at least once at said table and each number of said set having the same number of occurrences at said table as every other number of said set, for each one of said games selecting a set of conditions for winning said additional reward where said set of conditions includes the occurrence in said game of a number equal to the identification number of one of said play stations, acknowledging the occurrence of said selected set of conditions for winning by a player at a first play station having a given identification number where said first player has exercised said means for designating participation in said play for said additional reward, and paying a portion of said additional reward to said first player.

2. The method of claim 1 and further comprising the steps of providing a first plurality of play surfaces of said tables for use with a first game, providing a second plurality of play surfaces of said tables for use with a second game which is different from said first game, selecting a first set of conditions for winning by a player of said first game to win said additional reward, selecting a second set of conditions for winning by a player of said second game to win said additional reward, and said first set of conditions being different from said second set of conditions.

3. The method of claim 1 wherein one of said play surfaces is for playing the game of roulette and includes a roulette wheel having an outer race with numbered areas thereon where the numbers of said areas of said race are equal to the number of said play stations, and said conditions for winning occurring for a player at one of said numbered play stations when said player bets on a number associated with the number of said one of said numbered play stations, a roulette ball lands in a hole for said number and the roulette wheel comes to rest with said ball adjacent to one of said areas of said outer race bearing a number equal to said number of said one of said numbered play station.

4. The method of claim 1 wherein one of said play surfaces is for playing the game of blackjack, and said conditions for winning occurring for a player at one of said numbered play stations for said game of blackjack when said dealer's hand and said player's hand both have pairs and the numbers on all four cards are equal to the number of said one of said numbered play stations.

5. The method of claim 1 wherein one of said play surfaces is for playing the game of poker, and said conditions for winning occur for a player at one of said numbered play stations for said game of poker when the dealer's hand has four of a kind and all four cards have numbers equal to the number of said one of said numbered play stations.

6. The method of claim 1 wherein one of said play surfaces is for playing the game of roulette and includes a roulette wheel having an outer race with numbered areas thereon where the numbers of said areas of said race are equal to the number of said play stations, and said conditions for winning occur for a player at a first of said numbered play stations when said player bets on a selected number associated with the number of said first of said numbered play stations, a roulette ball lands in a hole for said selected number and the roulette wheel comes to rest with said ball adjacent to one of said areas of said outer race bearing a number equal to said number of said first of said numbered play station, a second of said play surfaces is for playing the game of blackjack, and said conditions for winning occur for a player at a second of said numbered play station for said game of blackjack when said dealer's hand and said player's hand both have pairs and the numbers on all four cards are equal to the number of said second of said numbered play stations, and a third of said play surfaces is for playing the game of poker, and said conditions for a winning occur for a player at a third of said numbered play stations for said game of poker when the dealer's hand has four of a kind and all four cards have numbers equal to the numbers of said third of said numbered play stations.

7. The method of providing a wagering for an additional reward to players of games of a casino comprising the steps of providing a plurality of gaming tables where said gaming tables where each of said gaming tables has a play surface for use in one of the games played at said casino, each said play surface having a plurality of play stations thereon with each play station for use by one of said players, all of said tables having the same given number of play stations or a multiple of said given number of play stations, a set of identification numbers equal in number to said given number, one identification number for each play station of a table with all of said set of numbers employed at least once and each number of said set having the same number of occurrences at said table as every other number of said set, providing means purchasable by one of said players in advance of play at one of said tables, said means exercisable by said one of said players prior to commencement of play at said one of said tables, said means being for the purpose of designating participation by said one of said players in the play for said additional award, for each one of said games selecting a set of conditions for winning said additional reward where said set of conditions includes the occurrence in said game of a number equal to the identification number of one of said play stations, acknowledging the occurrence of said selected set of conditions for winning by a first player at a first play station having a given identification number where said first player has exercised said means for designating participation in said play for said additional reward, and paying a portion of said additional reward to a second player sitting at a second play station bearing an identification symbol identical to the identification symbol of said first play station and where said second player has exercised said means for designating participation in said play for said additional reward.

8. The method of claim 7 and further comprising the steps of providing a first plurality of play surfaces of said tables for use with a first game, providing a second plurality of play surfaces of said tables for use with a second game which is different from said first game, selecting a first set of conditions for winning by a player of said first game to win said additional reward, selecting a second set of conditions for winning by a player of said second game to win said additional reward, and said first set of conditions being different from said second set of conditions.

9. The method of claim 8 wherein one of said play surfaces is for playing the game of roulette and includes a roulette wheel having an outer race with numbered areas thereon where the numbers of said areas of said race are equal to the number of said play stations, and said conditions for winning occurring for a player at one of said numbered play stations when said player bets on a number associated with the number of said one of said numbered play stations, a roulette ball lands in a hole for said number and the roulette wheel comes to rest with said ball adjacent to one of said areas of said outer race bearing a number equal to said number of said one of said numbered play station.

10. The method of claim 7 wherein one of said play surfaces is for playing the game of blackjack, and said conditions for winning occurring for a player at one of said numbered play stations for said game of blackjack when said dealer's hand and said player's hand both have pairs and the numbers on all four cards are equal to the number of said one of said numbered play stations.

11. The method of claim 7 wherein one of said play surfaces is for playing the game of poker, and said conditions for winning occur for a player at one of said numbered play stations for said game of poker when the dealer's hand has four of a kind and all four cards have numbers equal to the number of said one of said numbered play stations.

12. The method of claim 7 wherein one of said play surfaces is for playing the game of roulette and includes a roulette wheel having an outer race with numbered areas thereon where the numbers of said areas of said race are equal to the number of said play stations, and said conditions for winning occur for a player at a first of said numbered play stations when said player bets on a selected number associated with the number of said first of said numbered play stations, a roulette ball lands in a hole for said selected number and the roulette wheel comes to rest with said ball adjacent to one of said areas of said outer race bearing a number equal to said number of said first of said numbered play station, a second of said play surfaces is for playing the game of blackjack, and said conditions for winning occur for a player at a second of said numbered play station for said game of blackjack when said dealer's hand and said player's hand both have pairs and the numbers on all four cards are equal to the number of said second of said numbered play stations, and a third of said play surfaces is for playing the game of poker, and said conditions for a winning occur for a player at a third of said numbered play stations for said game of poker when the dealer's hand has four of a kind and all four cards have numbers equal to the numbers of said third of said numbered play stations.

13. The method of providing a wagering for an additional reward to players at gaming tables of a casino comprising the steps of providing means purchasable by a player in advance of play at one of said tables, said means exercisable by said player for designating participation by said player in the play for said additional award, providing a plurality of gaming tables where each of said gaming tables has a play surface for use in one of the games played at said casino, a given number of play stations on said play surfaces, each play station thereon for use by one of said players with all of said tables having the same given number of play stations or a multiple of that number of play stations, a set of identification numbers equal in number to said given number, one identification number for each play station of a table with all of said set of numbers employed at least once and each number of said set having the same number of occurrences at said table as every other number of said set, each play station having means for selecting an identification number of a play station where said selected identification number is different from the number of the play station from which the selection is made, for each one of said games selecting a set of conditions for winning said additional reward where said set of conditions includes the occurrence in said game of a number equal to the identification number of one of said play stations, acknowledging the occurrence of said selected set of conditions for winning by a player at a first play station having a given identification number where said first player has exercised said means for designating participation in said play for said additional reward, and paying a portion of said additional reward to a second player at a second play station at a second table where said second play station has an identification number different from said identification number of said first play station and where said second player has exercised said means for designating participation in said additional reward and said first identification number has been selected on said means for selecting.

14. The method of claim 13 and further comprising the steps of providing a first plurality of play surfaces of said tables for use with a first game, providing a second plurality of play surfaces of said tables for use with a second game which is different from said first game, selecting a first set of conditions for winning by a player of said first game to win said additional reward, selecting a second set of conditions for winning by a player of said second game to win said additional reward, and said first set of conditions being different from said second set of conditions.

15. The method of claim 13 wherein one of said play surfaces is for playing the game of roulette and includes a roulette wheel having an outer race with numbered areas thereon where the numbers of said areas of said race are equal to the number of said play stations, and said conditions for winning occurring for a player at one of said numbered play stations when said player bets on a number associated with the number of said one of said numbered play stations, a roulette ball lands in a hole for said number and the roulette wheel comes to rest with said ball adjacent to one of said areas of said outer race bearing a number equal to said number of said one of said numbered play station.

16. The method of claim 13 wherein one of said play surfaces is for playing the game of blackjack, and said conditions for winning occurring for a player at one of said numbered play stations for said game of blackjack when said dealer's hand and said player's hand both have pairs and the numbers on all four cards are equal to the number of said one of said numbered play stations.

17. The method of claim 13 wherein one of said play surfaces is for playing the game of poker, and said conditions for winning occur for a player at one of said numbered play stations for said game of poker when the dealer's hand has four of a kind and all four cards have numbers equal to the number of said one of said numbered play stations.

18. The method of claim 13 wherein one of said play surfaces is for playing the game of roulette and includes a roulette wheel having an outer race with numbered areas thereon where the numbers of said areas of said race are equal to the number of said play stations, and said conditions for winning occur for a player at a first of said numbered play stations when said player bets on a selected number associated with the number of said first of said numbered play stations, a roulette ball lands in a hole for said selected number and the roulette wheel comes to rest with said ball adjacent to one of said areas of said outer race bearing a number equal to said number of said first of said numbered play station, a second of said play surfaces is for playing the game of blackjack, and said conditions for winning occur for a player at a second of said numbered play station for said game of blackjack when said dealer's hand and said player's hand both have pairs and the numbers on all four cards are equal to the number of said second of said numbered play stations, and a third of said play surfaces is for playing the game of poker, and said conditions for a winning occur for a player at a third of said numbered play stations for said game of poker when the dealer's hand has four of a kind and all four cards have numbers equal to the numbers of said third of said numbered play stations.

19. The method of providing a wagering for an additional reward to players of the games of a casino comprising the steps of providing means purchasable by a player in advance of play of one of said games, said means exercisable by said player for designating participation by said player in the play for said additional award, providing a plurality of gaming tables where each of said gaming tables has a play surface for use in one of said games played at said casino, each said play surface having a plurality of play stations thereon for use by one of said players, wherein all of said tables have the same given number of play stations or a multiple of said given number of play stations, providing a set of identification numbers where the total number of distinct identification numbers in said set is equal to said given number, assigning one of said set of identification numbers to each play station of a table with all of said set of numbers employed at least once at said table and each number of said set having the same number of occurrences at said table as every other number of said set, for each one of said games selecting a set of conditions for winning said additional reward where said set of conditions includes the occurrence in said game of a number equal to the identification number of one of said play stations, providing a plurality of slot machines to form a bank of machines where the number of machines in said bank is equal to said given number, providing a receptor on each of said machines in said bank for receiving said means purchasable by a player, assigning one of said set of identification numbers to each of said machines in said bank with all of said numbers of said set employed to number machines of said bank, providing means for recording the occurrence of a winning combination on one of said machines of said bank when said means purchasable by a player has been deposited into said receptor, and paying a portion of said additional reward to a player at said one of said machines of said bank who has won the highest reward of said machine and has deposited one of said means purchasable by a player into said receptor prior to winning said highest reward.

20. The method of providing a wagering for an additional reward to players of games of a casino comprising the steps of providing a plurality of gaming tables where said gaming tables where each of said gaming tables has a play surface for use in one of the games played at said casino, each said play surface having a plurality of play stations thereon with each play station for use by one of said players, all of said tables having the same given number of play stations or a multiple of said given number of play stations, a set of identification numbers equal in number to said given number, one identification number for each play station of a table with all of said set of numbers employed at least once and each number of said set having the same number of occurrences at said table as every other number of said set, providing means purchasable by one of said players in advance of play at one of said tables, said means exercisable by said one of said players prior to commencement of play at said one of said tables, said means being for the purpose of designating participation by said one of said players in the play for said additional award, for each one of said games selecting a set of conditions for winning said additional reward where said set of conditions includes the occurrence in said game of a number equal to the identification number of one of said play stations, providing a plurality of slot machines to form a bank of machines where the number of machines in said bank is equal to said given number, providing a receptor on each of said machines in said bank for receiving said means purchasable by a player, assigning one of said set of identification numbers to each of said machines of said bank with all of said identification numbers of said set employed to number machines of said bank, providing a means for recording the occurrence of a winning combination on said machines of said bank when one of said means purchasable by a player has been deposited into said receptor, acknowledging the occurrence of said selected set of conditions for winning by a first player at a play station having a given identification number where said first player has exercised said means for designating participation in said play for said additional reward, and paying a portion of said additional reward to a second player sitting at one of said machines in said bank when said one of said machines bears an identification symbol identical to the identification symbol of said first play station and where said second player has deposited one of said means for designating into said receptor of said one of said machines.

21. The method of providing a wagering for an additional reward to the players of a slot machine comprising providing a plurality of slot machines each of which has a plurality of reels where each of said reels depicts a plurality of symbols, assigning one of said plurality of symbols to each one of said plurality of slot machines wherein no two of said plurality of slot machines is assigned the same one of said plurality of symbols, providing conditions for winning a game played on said plurality of slot machines where said conditions for winning include the repeated occurrence of at least one of said plurality of symbols on said reels, providing means purchasable by a player prior to the playing of a game on one of said slot machines, said means designating participation by said player in the play for said additional reward, providing means for recording the occurrence of a winning combination on the reels of one of said plurality of slot machines, paying a portion of said additional reward to a player at one of said slot machines where said player has purchased said means for designating participation in the play for said additional reward, and a winning combination has occurred on said one of said slot machines, and said winning combination includes the occurrence of a symbol on said reels identical to the symbol assigned to said one of said plurality of machines.

22. The method of providing a wagering for an additional reward to the players of slot machines where each of said slot machines has a first plurality of reels and where each of said reels depicts a second plurality of different symbols, said method comprising providing a third plurality of said slot machines to form at least two banks of said slot machines where the number of machines in each of said banks is equal to said second plurality, assigning one of said plurality of symbols to each one of said plurality of slot machines wherein no two of said plurality of slot machines is assigned the same one of said second plurality of symbols, providing conditions for winning a game played on said plurality of slot machines where said conditions for winning include the repeated occurrence of at least one of said plurality of symbols on said reels, providing means purchasable by a player prior to the playing of a game on one of said slot machines, said means designating participation by said player in the play for said additional reward, recording the occurrence of a winning combination on the reels of a first of said slot machines, and paying a portion of said additional reward to a player at a second of said slot machines where said first slot machine and said second slot machine are in different banks, said first slot machine and said second slot machine have the same symbol of said second plurality of different symbols assigned thereto, said player has purchased said means for designating participation in the play for said additional reward, and said winning combination occurring on said first slot machine includes the occurrence of said same symbol on said reels of said first slot machine.

23. The method of claim 22 and further including the step of providing means for recording the occurrence of a winning combination on the reels of one of said third plurality of slot machines.

24. The method of claim 22 and further comprising the step of providing a receptor on each of said slot machines in said at least two banks, said receptor for receiving said means purchasable by a player.

25. The method of providing a wagering for an additional reward to the players of a slot machine comprising providing a plurality of slot machines each of which has a plurality of reels where each of said reels depicts a plurality of symbols, assigning one of said plurality of symbols to each one of said plurality of slot machines wherein no two of said plurality of slot machines is assigned the same one of said plurality of symbols, for one of said plurality of slot machines providing means for selecting a symbol other than the symbol assigned to said one of said plurality of slot machines, providing conditions for winning a game played on a second of said plurality of slot machines where said conditions for winning include the repeated occurrence of one of said plurality of symbols on said reels and said repeated symbol is identical to said symbol assigned to said second of said plurality of slot machines, providing means purchasable by a player prior to the playing of a game on one of said slot machines, said means designating participation by said player in the play for said additional reward, acknowledging the occurrence of said winning combination at said second of said plurality of slot machines, and paying a portion of said additional reward to a player at said one of said plurality of slot machines where said player has purchased said means for designating participation in the play for said additional reward, and a winning combination has occurred on said second of said plurality of slot machines, and said player has selected a symbol identical to said symbol assigned to said second of said plurality of slot machines.

26. The method of providing a wagering for an additional reward to a player of a game at a casino comprising the steps of providing means purchasable by a player in advance of play at said game, tables, said means for designating participation by said player in the play for said additional award, providing a gaming table having a play surface for use in said game, a given number of play stations on said play surface, each play station thereon for use by one of said players, a set of identification symbols equal in number to said given number wherein one identification symbol is assigned to each play station and no two play stations bear the same symbol, and each play station having means for selecting an identification symbol of a play station where said selected identification symbol is different from the symbol of the play station at which said winning combination has occurred, selecting a set of winning conditions for winning said additional reward where said set of conditions includes the occurrence in said game of a symbol identical to the identification symbol of said play station from which the selection is made, acknowledging the occurrence of said winning conditions by a player at a first play station having a given identification symbol, and paying a portion of said additional reward to a second player at a second play station where said second play station has an identification symbol different from said identification symbol of said first play station and where said second player has purchased said means for participating in said additional reward and said first identification symbol has been selected on said means for selecting.

27. The method of providing a wagering for an additional reward to players of games of a casino comprising the steps of providing a plurality of gaming tables where said gaming tables where each of said gaming tables has a play surface for use in one of the games played at said casino, each said play surface having a plurality of play stations thereon with each play station for use by one of said players, all of said tables having the same given number of play stations or a multiple of said given number of play stations, a set of identification numbers equal in number to said given number, one identification number for each play station of a table with all of said set of numbers employed at least once and each number of said set having the same number of occurrences at said table as every other number of said set, providing means purchasable by one of said players in advance of play at one of said tables, said means exercisable by said one of said players prior to commencement of play at said one of said tables, said means being for the purpose of designating participation by said one of said players in the play for said additional award, for each one of said games selecting a set of conditions for winning said additional reward where said set of conditions includes the occurrence in said game of a number equal to the identification number of one of said play stations, acknowledging the occurrence of said selected set of conditions for winning by a first player at a first play station having a given identification number, and paying a portion of said additional reward to a second player sitting at a second play station bearing an identification symbol identical to the identification symbol of said first play station and where said second player has exercised said means for designating participation in said play for said additional reward.

* * * * *